United States Patent [19]

Bishop

[11] Patent Number: 4,726,584

[45] Date of Patent: Feb. 23, 1988

[54] SCENT RELEASING ARROW

[76] Inventor: Steven C. Bishop, 210 Washington, Macosta, Mich. 49332

[21] Appl. No.: 54,026

[22] Filed: May 26, 1987

[51] Int. Cl.[4] ..... F41B 5/02

[52] U.S. Cl. ..... 273/418; 102/367

[58] Field of Search ..... 273/418, 416; 102/334, 102/367–370

[56] References Cited

U.S. PATENT DOCUMENTS

| | | | |
|---|---|---|---|
| 2,444,283 | 6/1948 | Detrich | 102/370 |
| 2,854,925 | 10/1958 | Crockford et al. | 102/92 |
| 3,022,785 | 2/1962 | Crockford et al. | 128/218 |
| 3,150,875 | 9/1964 | Searles | 273/106.5 |
| 3,419,274 | 12/1968 | Tabor | 273/418 |
| 3,457,921 | 7/1969 | Waldeisen | 273/418 X |
| 3,565,435 | 2/1971 | Bear | 273/106.5 |
| 3,617,060 | 11/1971 | Iezzi | 273/106.5 R |
| 3,701,533 | 10/1972 | Palmer | 273/418 |
| 4,463,953 | 8/1984 | Jordan | 273/418 |

*Primary Examiner*—Paul E. Shapiro

*Attorney, Agent, or Firm*—Basile and Hanlon

[57] ABSTRACT

A luring scent releasing arrow includes a hollow tubular metal shaft having a pad of absorbent material located within the shaft adjacent a group of openings through the wall of the shaft. A sleeve is mounted on the shaft for sliding movement forwardly of the shaft from a position in which the sleeve covers and seals all of the openings to a position where all of the openings are uncovered. This movement is induced by the impact of the arrow upon a targeted location. The absorbent pad is saturated with a scented liquid by unthreading a detachable blunted arrow head from the forward end of the shaft and pouring the liquid into the shaft.

5 Claims, 3 Drawing Figures

SCENT RELEASING ARROW

BACKGROUND OF THE INVENTION

Because of the limited effective range of their equipment, most bow and arrow hunters will conceal themselves near a game trail or some other likely location and wait for their quarry to appear. Deer hunters in particular will frequently scatter, around their chosen location, strongly scented material whose odor is especially attractive to deer in the hope of luring a deer within range of their place of concealment. A wide variety of commercially produced scents for this purpose is available. Most of these commercially available scents are sold in a highly concentrated liquid form.

One problem encountered in using such scent is that the hunter, in setting out the scent, must walk to and return from the place where the scent is placed and thus, the scent of a human will, for some time after the luring scent has been placed, drift from that location. Deer in particular have a highly developed sense of smell and the effect of the luring scent will be negated if a deer detects the slightest amount of human scent combined with that of the luring scent.

The present invention is especially directed to a simple and effective solution to this problem.

SUMMARY OF THE INVENTION

In accordance with the present invention, an arrow employs a hollow tubular arrow shaft having a blunted and radially flanged arrow head threadably mounted at its forward end. A group of openings through the wall of the hollow arrow shaft are located within a reasonably short section of the length of the shaft and a pad of absorbent material, such as cotton, is positioned within the shaft to fill the shaft at the interior of the section in which the openings are located. A tubular sleeve which fits reasonably closely on the exterior of the shaft is mounted on the shaft for sliding movement relative to the shaft between a first postiion in which the sleeve overlies all of the openings and a second position displaced forwardly from the first position by a distance sufficient so that none of the openings are covered by the sleeve.

With the sleeve located in its first position, covering the openings, the arrow head is unthreaded from the shaft and a liquid scent is poured in through the open forward end of the shaft to thoroughly soak the pad. The arrow head is then replaced.

The hunter may, from a concealed posiiton, shoot the arrow to a selected location, and when the arrow head strikes, the impact of the blunted end and flange will cause the sleeve to slip from a covering relationship with respect to the openings to a position in which all of the openings are exposed to release the scent through the openings from the saturated pad within the arrow shaft. Because the arrow at this time will be located at a reasonable distance from the hunters point of concealment, there is little possiblity that the scent of the hunter will be mixed with the luring scent released from the arrow.

Other objects and features of the invention will become apparent by reference to the following specification and to the drawings.

IN THE DRAWINGS

A scent releasing arrow embodying the present invention includes an elongate hollow tubular metal arrow shaft designated generally 10 which is nocked and feathered in a conventional manner at its rearward end and internally threaded at its forward end to threadably receive a blunted arrow head 12 preferably formed with a radially projecting flange 14.

Figure 1:
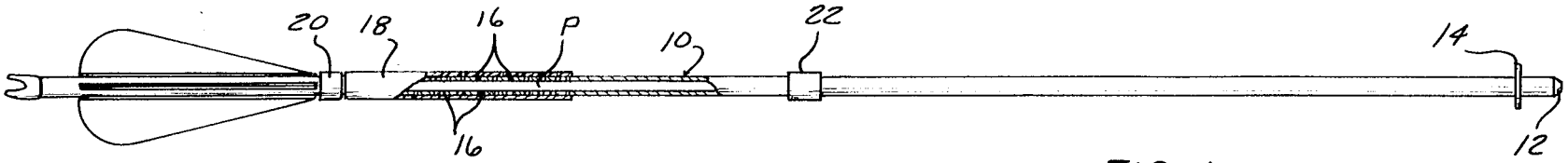
FIG. 1 is a side view with certain parts broken away and shown in section, of an arrow embodying the present invention.
Figure 2:
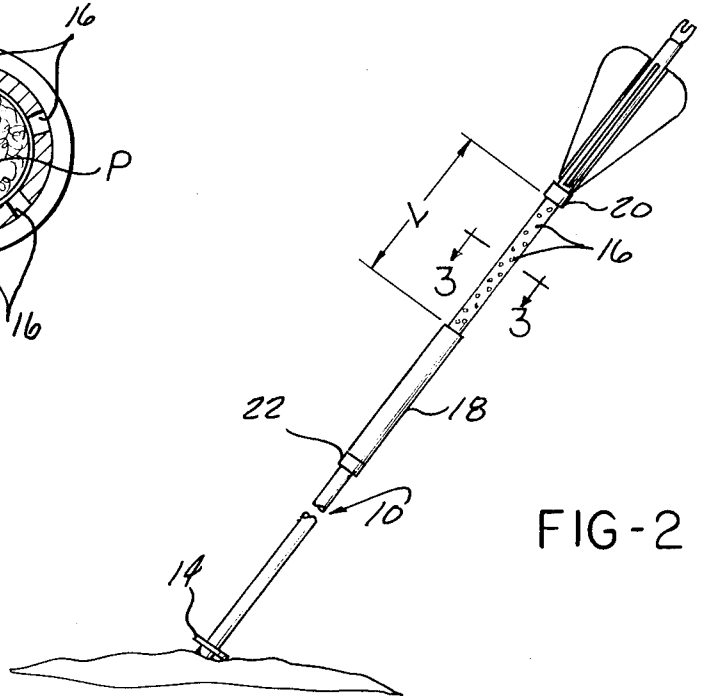
FIG. 2 is a side view of the arrow of FIG. 1, with the shaft broken away, showing the arrow in a scent releasing condition.
Figure 3:
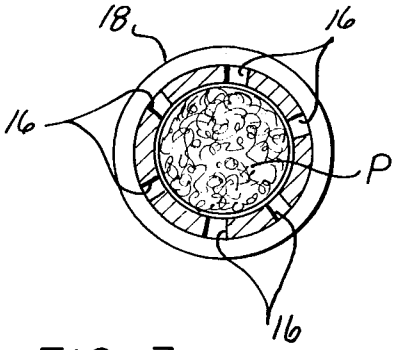
FIG. 3 is a cross-sectional view taken on line 3—3 of FIG. 2.

Shaft 10 is formed with a plurality of openings 16 which extend through the wall of the shaft and are all located within a section of the shaft of length L indicated on FIG. 2 of the drawings. Typically, the length L of the shaft section in which openings 16 are located will be approximately 4", but in any event the length L will be less than ½ of the length of shaft 10. A pad or plug P of absorbent material, such as absorbent cotton or some other material capable of absorbing and retaining a relatively large amount of liquid, is positioned within the interior of shaft 10 to extend axially over the entire portion of the shaft which is pierced by openings 16.

A hollow sleeve 18 is slip-fitted on the exterior of shaft 10. Preferably the fit of sleeve 18 upon shaft 10 is such that the sleeve will be loosely held against sliding movement relative to the shaft. The length of sleeve 18 is slightly greater than the length L of that poriton of the shaft in which openings 16 are located. Stop collars 20 and 22 respectively establish a rearward and forward end limit of movement of sleeve 18 relative to shaft 10. When sleeve 18 is engaged with rear stop collar 20, the sleeve is so located upon shaft 10 as to completely cover all openings 16. When sleeve 18 is engaged with the forward stop collar 22, the sleeve is displaced forwardly from openings 16 and all of openings 16 are exposed.

The internally located absorbent pad P functions to absorb and hold a fairly large quantity of liquid luring scent in the interior of shaft 10 at the inner side of openings 16. The pad P may be soaked with liquid scent by unthreading arrow head 12 from the forward end of the shaft and pouring the scent into the open end of the shaft. While this operation is being performed, sleeve 18 will be located in engagement with rear stop collar 20. After the pad P has been thoroughly soaked, arrow head 12 is replaced.

To set out the arrow, the hunter will simply shoot the arrow from his place of concealment to the desired location and the impact of the arrow striking the ground or a tree will be sufficient to cause sleeve 18 to slide forwardly from engagement with rear stop collar 20 into engagement with front stop collar 22, thereby uncovering openings 16 to permit the release of scent from the saturated pad P through openings 16. By taking prevailing wind conditions into consideration, the hunter can locate the arrow at a location where the scent from pad P will not be mixed with the scent from the hunter.

While one embodiment has been described in detail, it will be apparent to those skilled in the art that the disclosed embodiment may be modified. Therefore, the foregoing description is to be considered exemplary rather than limiting, and the true scope of the invention is that defined by the following claims.

In the claims:

1. A scent releasing device comprising an elongate hollow tubular shaft, access means detachably mounted at one end of said shaft for providing access to the interior of said shaft, scent releasing means in the interior of said shaft, means defining a plurality of openings through the wall of said shaft communicating with said scent releasing means, said openings being located within a first longitudinal section of said shaft of a length L spaced rearwardly from the forward end of said shaft by a distance greater than L, a hollow tubular sleeve of a length at least equal to L coaxially mounted on the exterior of said shaft for sliding movement along said shaft between a closed position wherein said sleeve is in overlying relationship with all of said openings to confine scent from said scent releasing means to the interior of said shaft and an open position wherein said sleeve is displaced forwardly on said shaft from said first section to expose all of said openings to enable scent from said scent releasing means to be released from the interior of said shaft through said openings.

2. The invention defined in claim 1 wherein said access means comprises an arrow head threadably mounted on the forward end of said shaft.

3. The invention defined in claim 2 further comprising flange means for limiting the penetration of said arrow head.

4. The invention defined in either of claim 1 or claim 3 further comprising a first stop collar fixedly mounted on said shaft adjacent the rearward end of said first section engageable with one end of said sleeve to establish said closed position of said sleeve.

5. The invention defined in claim 1 wherein said scent releasing means comprises an absorbant pad of material located within said shaft adjacent said openings adapted to be saturated with a scented liquid.

* * * * *